US011131279B1

(12) United States Patent
Martin

(10) Patent No.: US 11,131,279 B1
(45) Date of Patent: Sep. 28, 2021

(54) INTAKE MANIFOLD

(71) Applicant: James Martin, Beaverton, MI (US)

(72) Inventor: James Martin, Beaverton, MI (US)

( * ) Notice: Subject to any disclaimer, the term of this patent is extended or adjusted under 35 U.S.C. 154(b) by 0 days.

(21) Appl. No.: 16/951,287

(22) Filed: Nov. 18, 2020

(51) Int. Cl.
*F02M 35/10* (2006.01)
*F02M 35/104* (2006.01)

(52) U.S. Cl.
CPC .... *F02M 35/104* (2013.01); *F02M 35/10072* (2013.01); *F02M 35/10078* (2013.01); *F02M 35/10196* (2013.01); *F02M 35/10216* (2013.01); *F02M 35/10321* (2013.01); *F02M 35/10327* (2013.01)

(58) Field of Classification Search
CPC ..... F02M 35/104; F02M 35/10072; F02M 35/10078; F02M 35/10196; F02M 35/10216; F02M 35/10321; F02M 35/10327; F02M 35/10; F02B 77/13
See application file for complete search history.

(56) References Cited

U.S. PATENT DOCUMENTS 3,990,414 A * 11/1976 Malphettes ..... F02M 35/14 123/184.57
4,301,775 A * 11/1981 Smart ..... F02M 35/10268 123/184.61
7,950,363 B2 * 5/2011 Currie ..... F02M 35/10295 123/184.57

* cited by examiner

*Primary Examiner* — Syed O Hasan

(57) ABSTRACT

An intake manifold that allows air to flow through the intake manifold, engine, and exhaust from the engine, until the engine is cooled to a desired temperature.

9 Claims, 7 Drawing Sheets

INTAKE MANIFOLD

BACKGROUND OF THE INVENTION

In automotive engineering, an inlet manifold or intake manifold is the part of an engine that supplies the fuel/air mixture to the cylinders.

The primary function of the intake manifold is to evenly distribute a combustion mixture (or just air in a direct injection engine) to each intake port in the cylinder heads. Even distribution is important to optimize the efficiency and performance of the engine. It may also serve as a mount for the carburetor, throttle body, fuel injectors and other components of the engine.

Due to the downward movement of the pistons and the restriction caused by the throttle valve, in a reciprocating spark ignition piston engine, a partial vacuum exists in the intake manifold.

Intake manifolds have historically been manufactured from aluminum or cast iron, but the use of composite plastic materials is gaining popularity. The intake manifold of this invention can be fabricated from composite thermoplastics.

THE INVENTION

The intake manifold of this invention incorporates a cooling function that allows one to cool the engine from the inside-out rather than from the outside-in. In the industry of racing, almost everyone cools the engine by putting fans on the outside of the engine. The device of this invention also incorporates an additional built-in vacuum chamber that feeds vacuum into the main intake manifold runner. These components of the device of the instant invention stabilize the main intake runner pulse signal, giving improved throttle response and reducing low end engine stumbles.

Thus, the present invention is an intake manifold. The intake manifold comprises a unitary housing that has a top, a forward end and a back end and located within the unitary housing is a vacuum chamber surmounting a main intake manifold runner. The forward end has at least one feed through opening from the vacuum chamber into the main intake manifold. The feed through openings are inclined downwardly towards the forward end at an angle in the range of about 35° to 45° from horizontal. The vacuum chamber is inclined downwardly at an angle of 1 to 4° from horizontal, towards the forward end.

There is an air connection port mounted on the unitary housing that has a through opening into the vacuum chamber.

There is a fuel pump vacuum port extending from the top of the housing into the main intake manifold runner through the forward wall of the unitary housing.

There is a fuel carburetor mounting plate mounted on the forward end of the unitary housing. The carburetor mounting plate has at least three openings for bolt insertion for mounting the intake manifold to a fuel carburetor. The carburetor mounting plate has a through opening the same size as the main intake manifold runner and in alignment therewith.

There is a support rib mounted on a bottom of the unitary housing. The support rib has at least one opening therethrough for bolt insertion for supporting the intake manifold.

The unitary housing has at least two through openings for bolt insertion for mounting the intake manifold to an engine block.

In another embodiment, there is in combination a fuel carburetor mounted to an air intake manifold of this invention. The air intake manifold is mounted to a fuel operated engine block.

In yet another embodiment, there is a method of cooling a hot fuel operated engine. The method comprising providing a fuel operated engine with an intake manifold of this invention. The intake manifold is mounted between an engine block and a fuel carburetor. The method of operating the engine includes stopping the engine, attaching an air hose to the air connection port. Then allowing air to flow through the intake manifold, engine, and exhaust from the engine until the engine is cooled to a desired temperature.

Also contemplated within this invention is an intake manifold wherein the intake manifold is manufactured from metal or plastic, wherein the metal can be aluminum and the plastic can be thermoplastic, wherein the thermoplastic can be, for example, ABS, the most commonly used thermoplastic in 3D printing. ABS is a thermoplastic which contains a base of elastomers based on polybutadiene, making it more flexible, and resistant to shocks.

In still another embodiment, there is an intake manifold wherein the intake manifold comprises in combination, a housing, wherein the housing has a forward end and a back end and located within the housing is a main intake manifold runner; a vacuum chamber mounted to the outside of the housing; a hose providing a connection between the vacuum chamber and the main intake manifold runner through a feed opening in the main intake manifold runner. The feed opening is inclined downwardly towards the forward end at an angle in the range of about 35° to 45° from horizontal. The main intake manifold runner is inclined downwardly at an angle of 1° to 4° from horizontal towards the forward end; an air connection port mounted in a unitary housing wall that has a through opening into the vacuum chamber; a fuel pump vacuum port extending from the housing into the main intake manifold runner through the unitary housing; a fuel carburetor mounting plate mounted on the forward end of the unitary housing. The carburetor mounting plate has at least three openings for bolt insertion for mounting the intake manifold to a fuel carburetor. The carburetor mounting plate has a through opening the same size as the main intake manifold runner and in alignment therewith.

There is a unitary housing that has at least two through openings for bolt insertion for mounting the intake manifold to an engine block.

The angle of the feed openings and main intake manifold runner are important because as fuel tends to be heavy, it tends to want to lay in the bottom of the intake runner, and the angles are targeted to keep the fuel moving forward with the intake pulse signal.

In another embodiment the present invention is an intake manifold. The intake manifold comprises in combination a housing, wherein the housing has a forward end and a forward end and located within the housing is a main intake manifold runner.

There are two vacuum chambers, each mounted to the outside of the housing. Each vacuum chamber has a hose providing a connection between the vacuum chamber and the main intake manifold runner through separate feed openings in the main intake manifold runner. Each of the feed openings are inclined downwardly towards the forward end at an angle in the range of about 35° to 45° from horizontal. The main intake manifold runner is inclined downwardly at an angle of 1° to 4° from horizontal towards the forward end. There is an air connection port mounted in a unitary housing wall that has a through opening into the main intake manifold runner.

There is a fuel pump vacuum port extending from the housing into the main intake manifold runner through the unitary housing.

There is a fuel carburetor mounting plate mounted on the forward end of the unitary housing. The carburetor mounting plate has at least three openings for bolt insertion for mounting the intake manifold to a fuel carburetor. The carburetor mounting plate has a through opening the same size as the main intake manifold runner and in alignment therewith.

The unitary housing has at least two through openings for bolt insertion for mounting the intake manifold to an engine block.

DETAILED DESCRIPTION OF THE DRAWINGS

Figure 1:
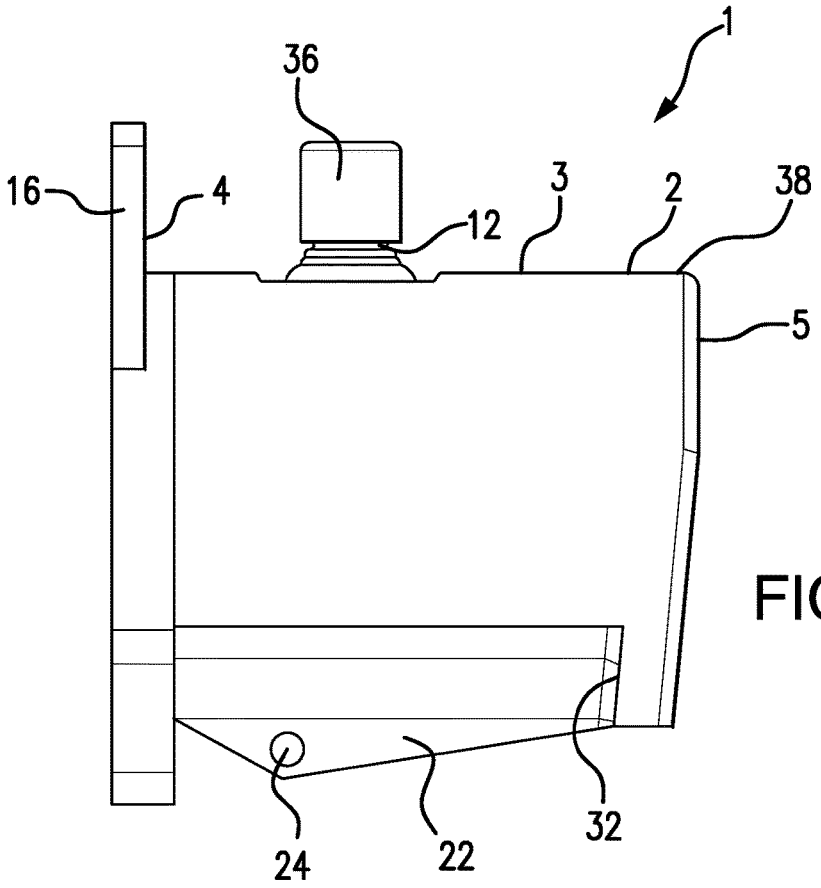
FIG. 1 is a full side view of the intake manifold.
Figure 2:
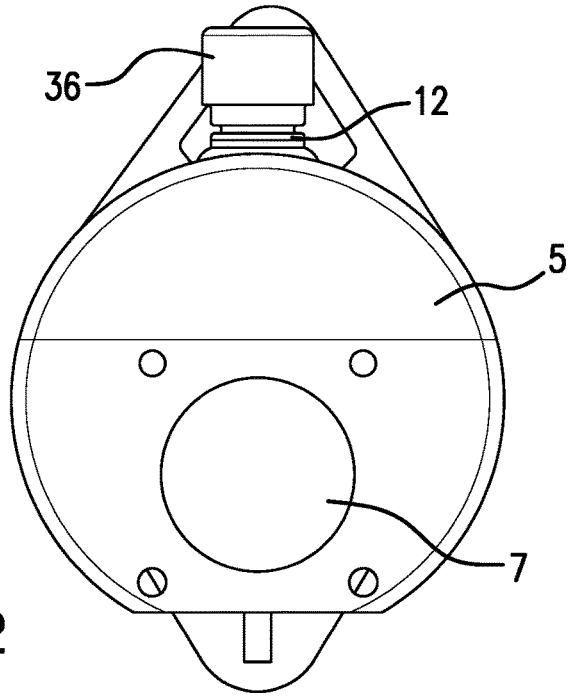
FIG. 2 is a full front view of the intake manifold (forward end).

FIG. 1 shows a full side view of the intake manifold 1 of this invention. The intake manifold 1 comprises a unitary housing 2 that has a top 3, a back end 4 and a forward end 5. Located within the unitary housing 2 is a vacuum chamber 6 (FIG. 8) surmounting a main intake manifold runner 7 (FIG. 2). The forward end 5 has at least one feed through opening 8 (FIG. 7) from the vacuum chamber 6 into the main intake manifold 1. The feed through openings 8 inclined downwardly towards the forward end 5 at an angle 9 (FIG. 7) in the range of about 35° to 45° from horizontal. The vacuum chamber 6 is inclined downwardly at an angle 10 (FIG. 8) of 1 to 4° from horizontal, towards the forward end 5.

There is an air connection port 12 mounted on the unitary housing 2 that has a through opening 8 into the vacuum chamber 6. The air connection port has a cap 36.

With the engine in a position where both valves are open, a blower or compressed air is applied to the top of the intake manifold 1 through the air connection port 12. The air then goes through the vacuum chamber into the main intake manifold runner then by intake valve and out the exhaust. This directly cools all internal engine components that typically see the most heat during normal running conditions. The cooling is accomplished with the engine in the off position.

There is a fuel pump vacuum port 38 extending from the top 3 of the housing 2 into the main intake manifold runner 7 through the forward wall 14 of the unitary housing 2.

Figure 6:
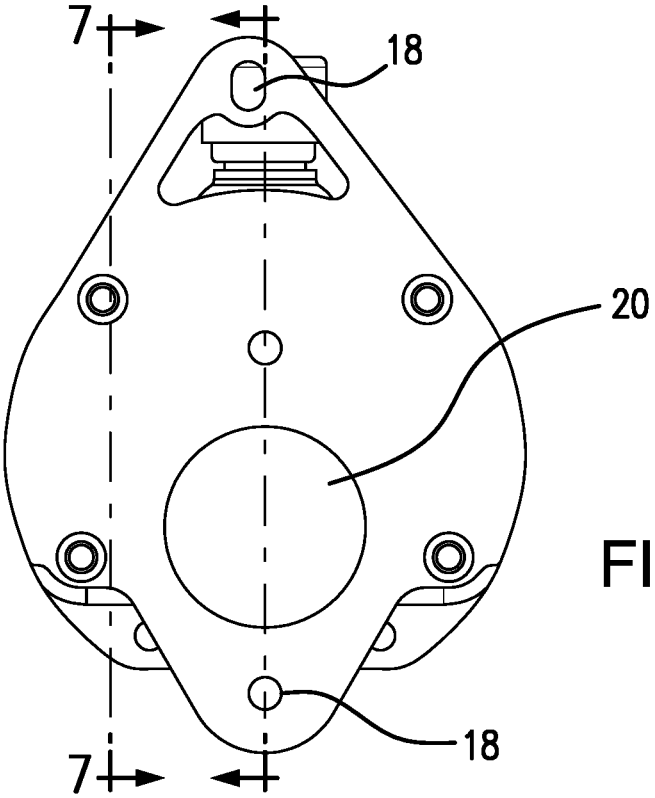
FIG. 6 is a full front view of the intake manifold showing the carburetor mounting plate including line A-A and line D-D.
Figure 12:
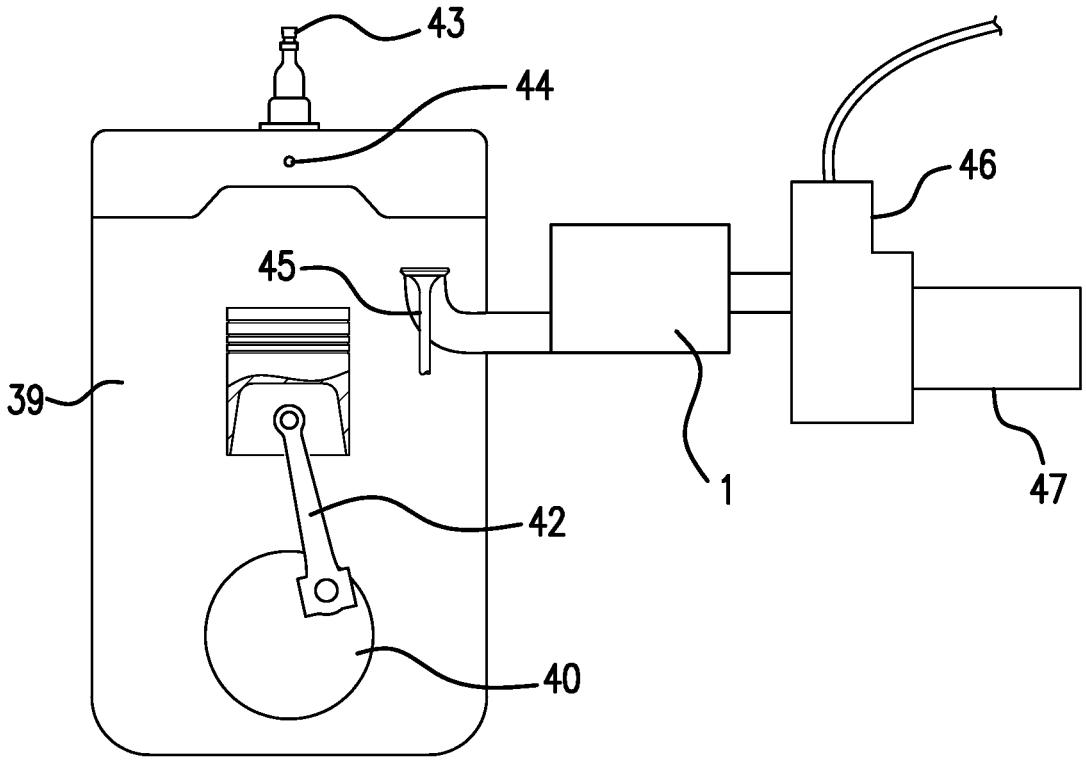
FIG. 12 is a schematic of the intake manifold of this invention installed on an engine block.

There is a fuel carburetor mounting plate 16 mounted on the forward end 5 of the unitary housing 2. The carburetor mounting plate 16 has at least three openings 18 (FIG. 6) for bolt insertion for mounting the intake manifold 1 to a fuel carburetor (FIG. 12). The carburetor mounting plate 16 has a through opening 20 the same size as the main intake manifold runner 7 and in alignment therewith (FIG. 6).

There is a support rib mounted 22 on a bottom 32 of the unitary housing 2. The support rib 22 has at least one opening therethrough 24 for bolt insertion for supporting the intake manifold 1.

The unitary housing 2 has at least two through openings 26 for bolt insertion for mounting the intake manifold 1 to an engine block (FIG. 12).

Also, there is in combination a fuel carburetor mounted to an air intake manifold 1. The air intake manifold 1 mounted to a fuel operated engine block (FIG. 12).

In the of method of cooling a hot fuel operated engine, the method comprises providing a fuel operated engine (FIG. 12) with an intake manifold 1. The intake manifold 1 is mounted between an engine block and a fuel carburetor. The method of operating the engine 30 includes: stopping the engine 30, attaching an air hose 34 to the air connection port 12, allowing air to flow through the intake manifold 1, engine, and exhaust from the engine until the engine is cooled to a desired temperature.

FIG. 2 shows the intake manifold 1 from the back 4. Located within the unitary housing 2 is a vacuum chamber 6 (FIG. 8) surmounting a main intake manifold runner 7. The air connection port has a cap 36. There is a fuel pump vacuum port 38 extending from the top 3 of the housing 2 into the main intake manifold runner 7 through the forward wall 14 of the unitary housing 12.

Figure 3:
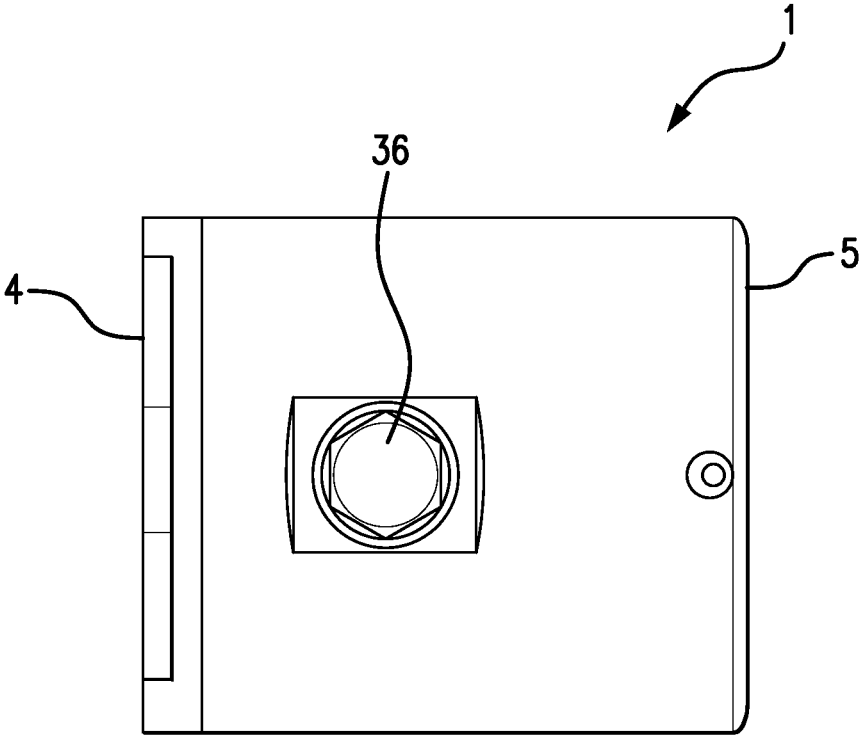
FIG. 3 is a full top view of the intake manifold from the top including line C-C.

FIG. 3 shows the intake manifold from the top 3 including line C-C. Shown is the forward end 4 and the back end 5. The air connector port cap 36 is also shown.

Figure 4:
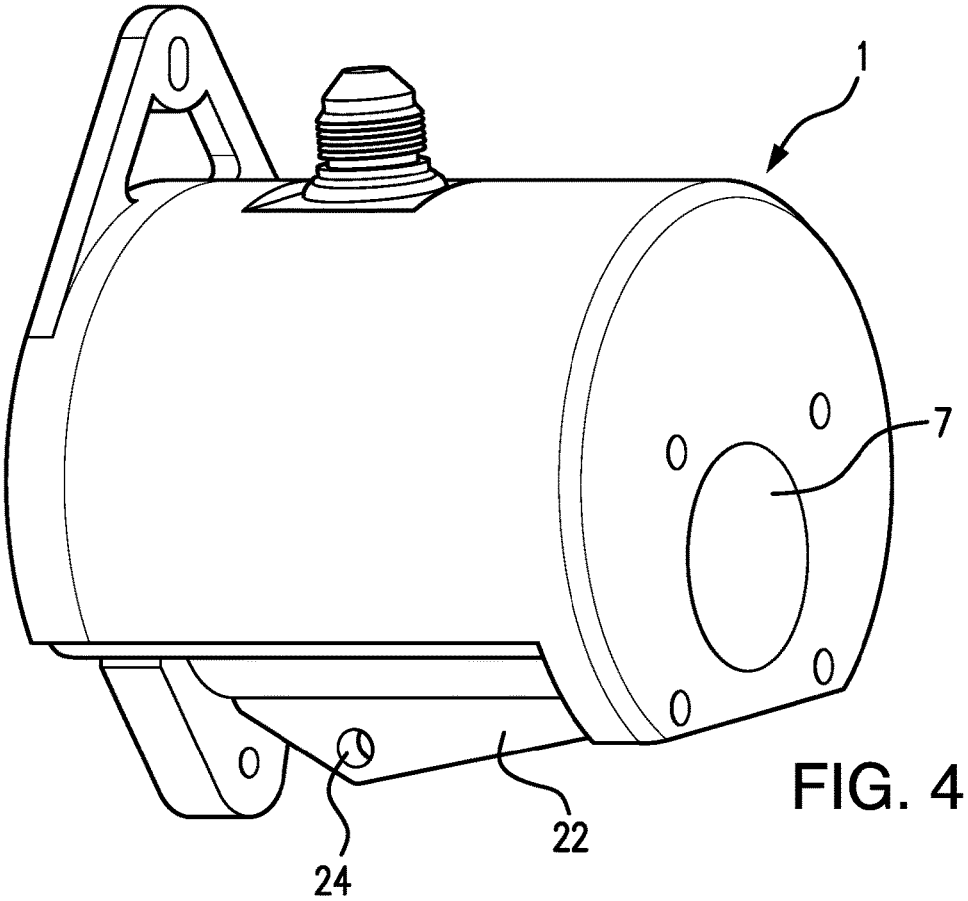
FIG. 4 is a full side view of the intake manifold.

FIG. 4 shows the intake manifold 1 from the side. The air connection port 12 on the top 3 of the unitary housing 2. There is a fuel pump vacuum port 38 extending from the top 3 of the housing 2 into the main intake manifold runner 7 through the forward wall 14 of the unitary housing 2.

Figure 5:
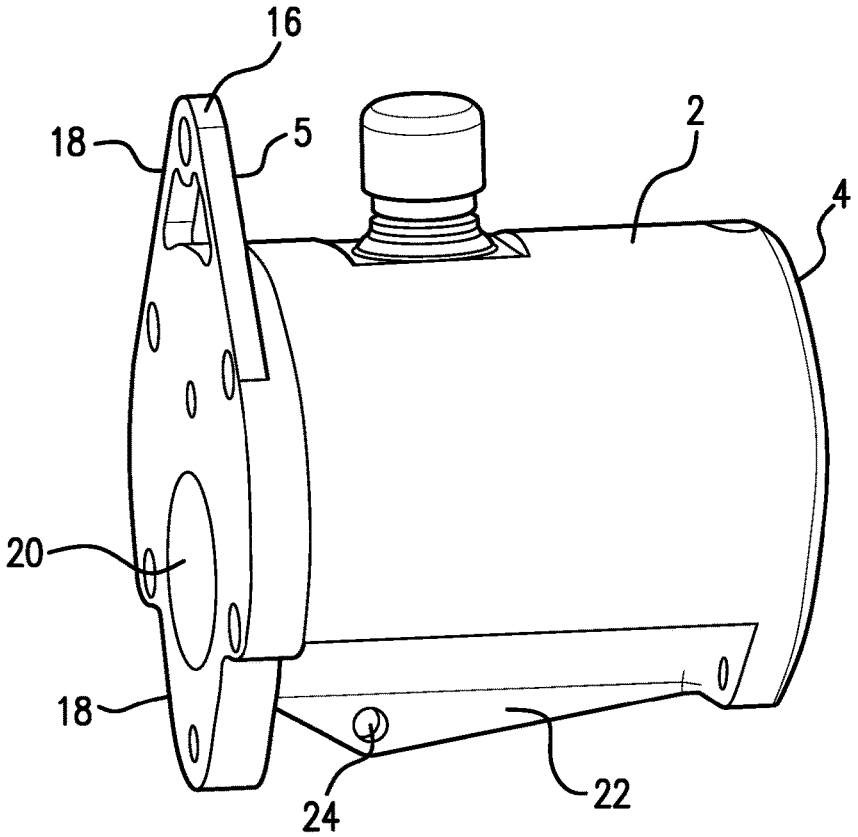
FIG. 5 is a view in perspective of the intake manifold.

FIG. 5 shows the intake manifold from the side.

There is a fuel carburetor mounting plate 16 mounted on the forward end 5 of the unitary housing 2. The carburetor mounting plate 16 has at least three openings 18 for bolt insertion for mounting the intake manifold 1 to a fuel carburetor, not shown. The carburetor mounting plate 16 has a through opening 20 the same size as the main intake manifold runner 7 and in alignment therewith.

FIG. 6 shows the intake manifold from carburetor mounting plate including line A-A and line D-D. There is a fuel carburetor mounting plate 16 mounted on the forward end 5 of the unitary housing 2. The carburetor mounting plate 16 has at least three openings 18 for bolt insertion for mounting the intake manifold 1 to a fuel carburetor, not shown. The carburetor mounting plate 16 has a through opening 20 the same size as the main intake manifold runner 7 and in alignment therewith.

Figure 7:
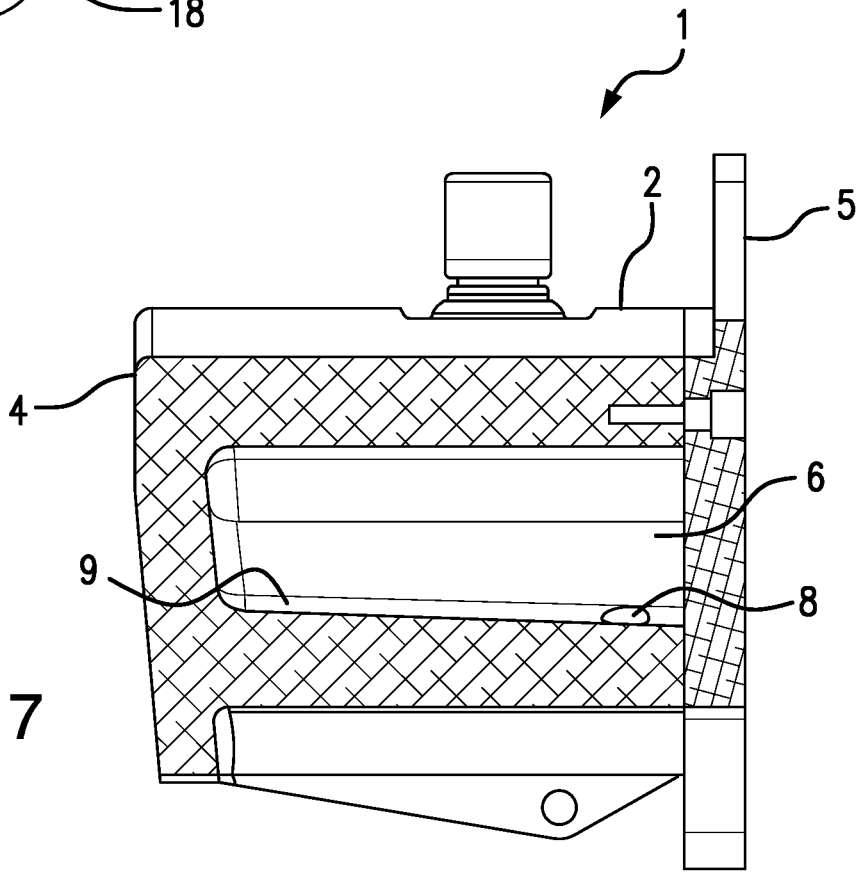
FIG. 7 is a full cross-sectional side view through line D-D of FIG. 6.

FIG. 7 shows the intake manifold. Located within the unitary housing 2 is a vacuum chamber 6 (FIG. 8) surmounting a main intake manifold runner 7 (FIG. 2). The forward end 5 has at least one feed through opening 8 (FIG. 8) from the vacuum chamber 6 into the main intake manifold 1. The feed through openings 8 are inclined downwardly towards the forward end 5 at an angle 9 in the range of about 35° to 45° from horizontal. The vacuum chamber 6 is inclined downwardly at an angle 10 of 1 to 4° from horizontal, towards the forward end 5.

The vacuum chamber 6 feeds vacuum into the main intake manifold runner. When vacuum is required it flows from the vacuum camber 6 into the main intake manifold runner, this happens through the feed openings 8 located at the infeed of the manifold. The vacuum chamber 6 is design with tapered floors that allows any liquid build-up that has accumulated in the vacuum chamber 6 to drain back into the main intake manifold runner. The feed openings 8 are positioned for optimal vacuum flow, drain back ability and functionality of the main intake manifold runner. The feed opening 8 positions always keep the main intake manifold runner clear of excessive fluid.

There is an air connection port 12 mounted on the unitary housing 2 that has a through opening 8 into the vacuum chamber 6. The air connection port has a cap 36.

There is a fuel pump vacuum port 38 extending from the top 3 of the housing 2 into the main intake manifold runner 7 through the forward wall 14 of the unitary housing 2.

There is a fuel carburetor mounting plate 16 mounted on the forward end 5 of the unitary housing 2. The carburetor mounting plate 16 has at least three openings 18 (FIG. 6) for bolt insertion for mounting the intake manifold 1 to a fuel carburetor, not shown. The carburetor mounting plate 16 has a through opening 20 the same size as the main intake manifold runner 7 and in alignment therewith (FIG. 6).

There is a support rib mounted 22 on a bottom 32 of the unitary housing 2. The support rib 22 has at least one opening therethrough 24 for bolt insertion for supporting the intake manifold 1.

The unitary housing 2 has at least two through openings 26 for bolt insertion for mounting the intake manifold 1 to an engine block.

Figure 8:
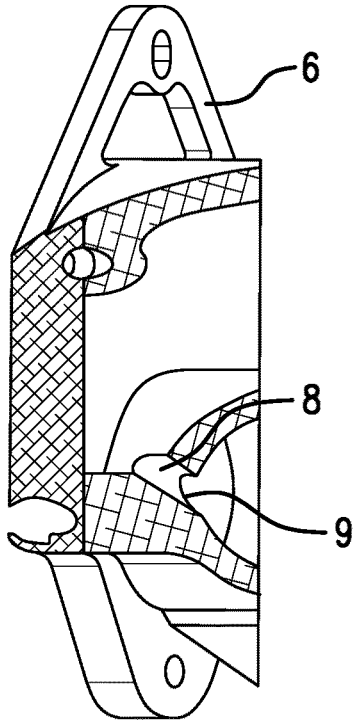
FIG. 8 shows a cross-sectional view through line C-C of FIG. 3.

FIG. 8 shows the intake manifold along line C-C. Shown are the feed openings 8 and their angle 9.

Figure 9:
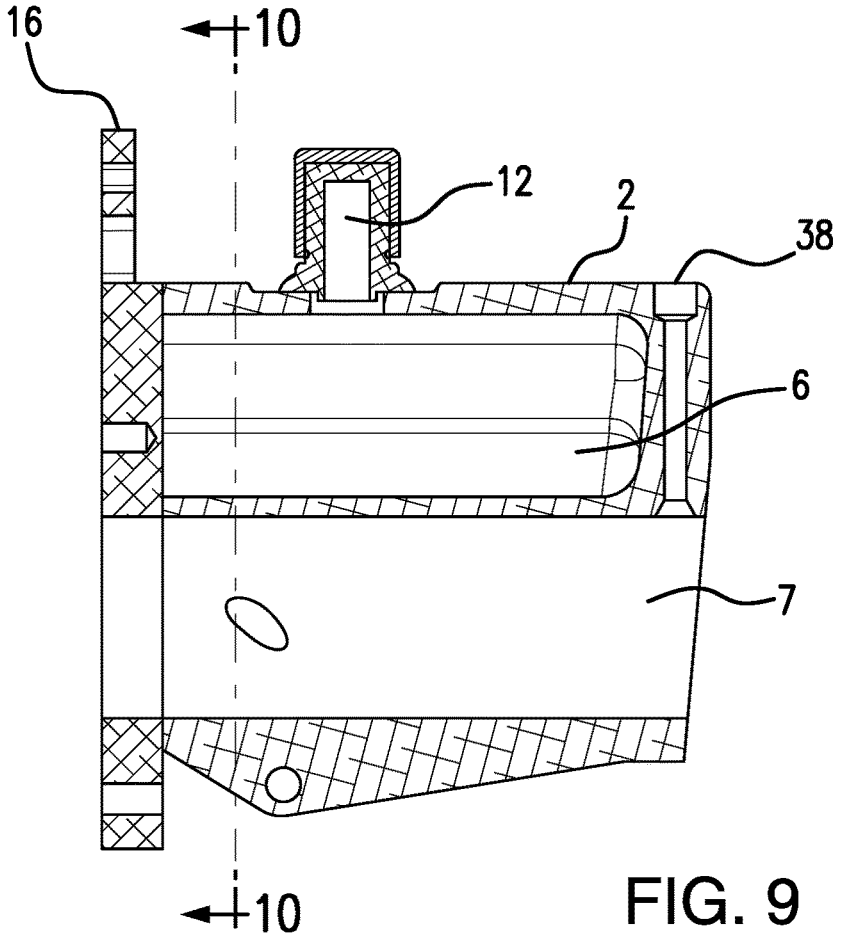
FIG. 9 is a full cross-sectional side view through line A-A of FIG. 6.

FIG. 9 shows the intake manifold along line A-A including line B-B. There is an air connection port 12 mounted on the unitary housing 2 that has a through opening 8 into the vacuum chamber 6. The air connection port has a cap 36.

There is a fuel pump vacuum port 38 extending from the top 3 of the housing 2 into the main intake manifold runner 7 through the forward wall 14 of the unitary housing 2.

Figure 10:
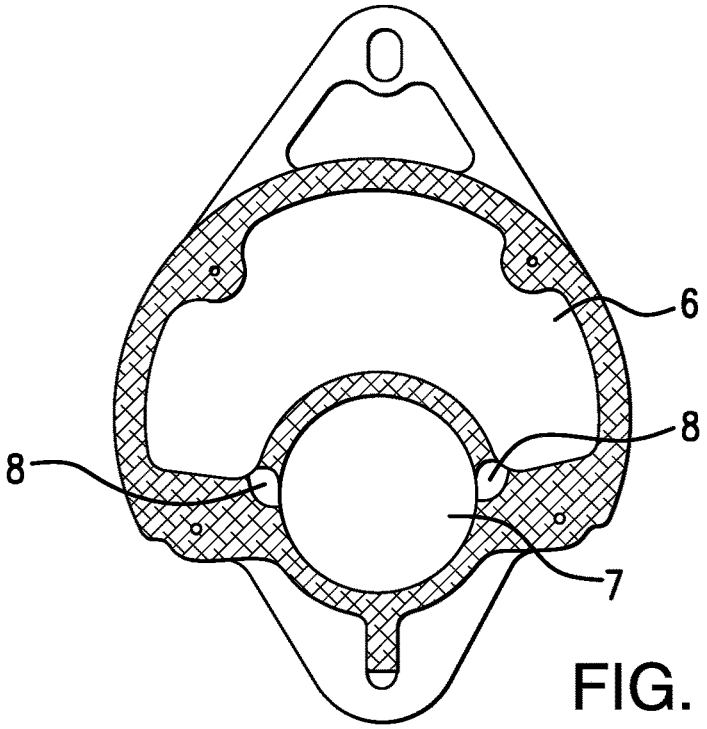
FIG. 10 is a full end view through line B-B of FIG. 9.

FIG. 10 shows the intake manifold along line B-B. Shown is the relationship between the vacuum chamber 6, the main intake manifold runner 7 and the feed holes 8.

Figure 11:
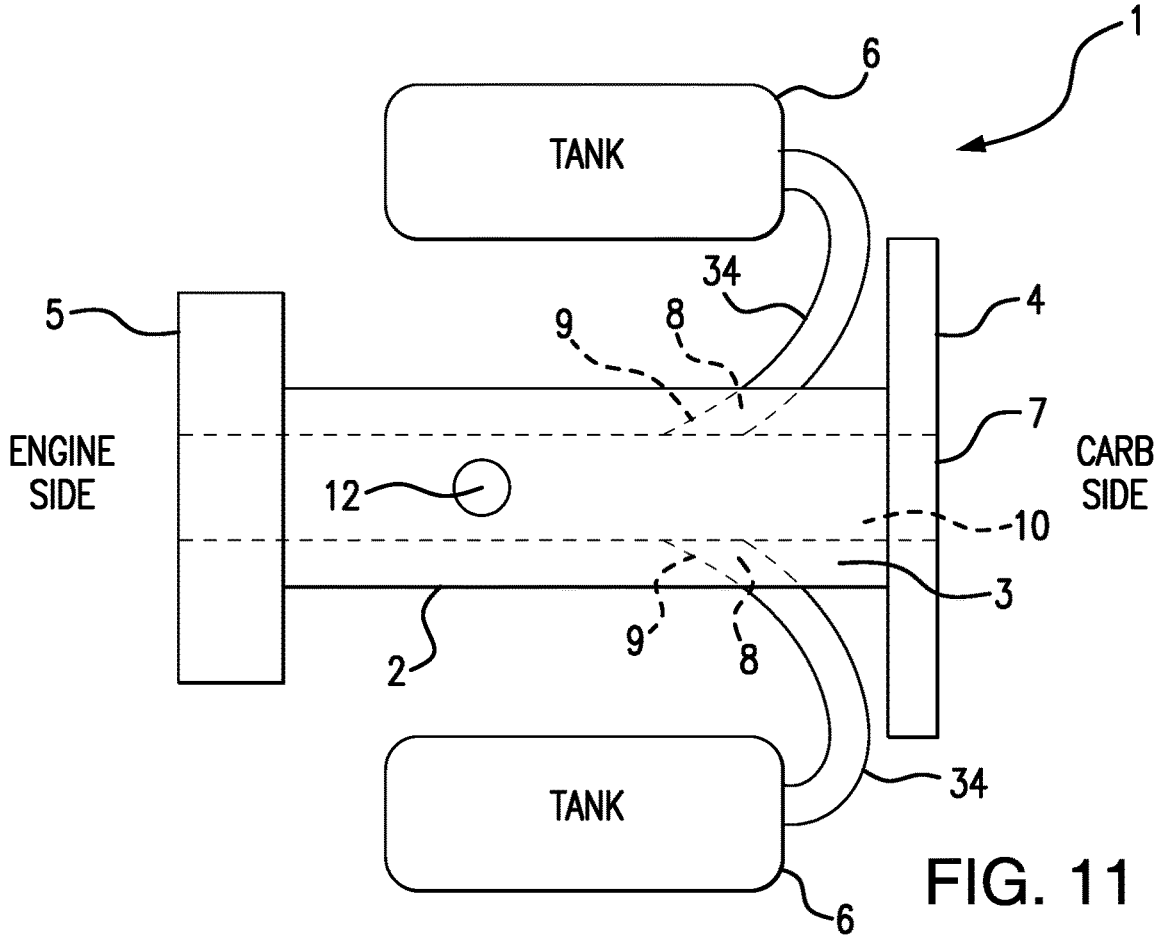
FIG. 11 is a full top view of another embodiment of an intake manifold.

FIG. 11 shows another embodiment of an intake manifold 1 from the top 3. The intake manifold 1 comprises in combination a housing 2, wherein the housing 2 has a back end 4 and a forward end 5 and located within the housing 2 is a main intake manifold runner 7.

There are two vacuum chambers 6, each mounted to the outside of the housing 4. Each vacuum chamber 6 has a hose 34 providing a connection between the vacuum chamber 6 and the main intake manifold runner 7 through separate feed openings 42 in the main intake manifold runner 7. Each of the feed opening 8 inclined downwardly towards the forward end 4 at an angle 9 in the range of about 35° to 45° from horizontal. The main intake manifold runner 7 is inclined downwardly at an angle 10 of 1° to 4° from horizontal towards the forward end 4. There is an air connection port 12 mounted in a unitary housing 2 wall 14 that has a through opening 20 into the main intake manifold runner 7.

There is a fuel pump vacuum port 38 extending from the housing 4 into the main intake manifold runner 7 through the unitary housing 2.

There is a fuel carburetor mounting plate 16 mounted on the forward end 5 of the unitary housing 2. The carburetor mounting plate 16 has at least three openings 18 for bolt insertion for mounting 16 the intake manifold 1 to a fuel carburetor. The carburetor mounting plate 16 has a through openings 18 the same size as the main intake manifold runner 7 and in alignment therewith.

The unitary housing 2 has at least two through openings 26 for bolt insertion for mounting the intake manifold 1 to an engine block.

FIG. 12 is a schematic showing the intake manifold adapted to an automobile engine. There is shown the engine 39, containing a crankshaft 40, piston 41, piston rod 42, sparkplug 43, thermometer port 44 and intake valve 45. Attached to the engine 39 is an intake manifold 1 of this invention and attached to the intake manifold 1 is a carburetor 46 that has an air filter 47 mounted to it.

What is claimed is:

1. An intake manifold, said intake manifold comprising: a unitary housing having a top, a back end and a forward end, and located within said unitary housing, a vacuum chamber surmounting a main intake manifold runner, said forward end having at least one feed through opening from said vacuum chamber into said main intake manifold, said feed through opening inclined downwardly towards said forward end at an angle in the range of about 35° to 45° from horizontal, said vacuum chamber being inclined downwardly at an angle of 1 to 4° from horizontal, towards the forward end; an air connection port mounted on said unitary housing having a through opening into said vacuum chamber; a fuel pump vacuum port extending from said top of said housing into said main intake manifold runner through said forward wall of said unitary housing; a fuel carburetor mounting plate mounted on said forward end of said unitary housing, said carburetor mounting plate having at least three openings for bolt insertion for mounting said intake manifold to a fuel carburetor, said carburetor mounting plate having a through opening the same size as said main intake manifold runner, and in alignment therewith; a support rib mounted on a bottom of said unitary housing, said support rib having at least one opening therethrough for bolt insertion for supporting said intake manifold; said unitary housing having at least two through openings for bolt insertion for mounting said intake manifold to an engine block.

2. In combination, a fuel carburetor mounted to an air intake manifold as claimed in claim 1, said air intake manifold mounted to a fuel operated engine block.

3. A method of cooling a hot fuel operated engine, said method comprising: providing a fuel operated engine with an intake manifold as claimed in claim 1, said intake manifold mounted between an engine block and a fuel carburetor; operating said engine; stopping said engine; attaching an air hose to said air connection port; allowing air to flow through said intake manifold, engine, and exhaust from said engine until said engine is cooled to a desired temperature.

4. An intake manifold as claimed in claim 1 wherein the intake manifold is manufactured from metal.

5. An intake manifold as claimed in claim 4 wherein the metal is aluminum.

6. An intake manifold as claimed in claim 1 wherein the intake manifold is manufactured from thermoplastic.

7. An intake manifold as claimed in claim 6 wherein the plastic is ABS filament which is a thermoplastic which contains a base of elastomers based on polybutadiene.

8. An intake manifold, said intake manifold comprising in combination: a housing, wherein said housing has a back end and a forward end, and located within said housing, a main intake manifold runner; a vacuum chamber mounted to the outside of said housing, there being a hose providing a connection between said vacuum chamber and said main intake manifold runner through a feed opening in said main intake manifold runner, said feed opening inclined downwardly towards said forward end at an angle in the range of about 35° to 45° from horizontal, said main intake manifold runner being inclined downwardly at an angle of 1° to 4° from horizontal, towards said forward end; an air connection port mounted in a unitary housing wall having a through opening into said vacuum chamber; a fuel pump vacuum port extending from said housing into said main intake manifold runner through said unitary housing; a fuel carburetor mounting plate mounted on said forward end of said unitary housing, said carburetor mounting plate having at least three openings for bolt insertion for mounting said intake manifold to a fuel carburetor, said carburetor mounting plate having a through opening the same size as said main intake manifold runner, and in alignment therewith; said unitary housing having at least two through openings for bolt insertion for mounting said intake manifold to an engine block.

9. An intake manifold, said intake manifold comprising in combination: a housing, wherein said housing has a forward end and a forward end, and located within said housing, a main intake manifold runner; two vacuum chambers, each mounted to the outside of said housing, each vacuum chamber having a hose providing a connection between said vacuum chamber and said main intake manifold runner through separate feed openings in said main intake manifold runner, each said feed opening inclined downwardly towards said forward end at an angle in the range of about 35° to 45° from horizontal, said main intake manifold runner being inclined downwardly at an angle of 1° to 4° from horizontal, towards said forward end; an air connection port mounted in a unitary housing wall having a through opening into said main intake manifold runner; a fuel pump vacuum port extending from said housing into said main intake manifold runner through said unitary housing; a fuel carburetor mounting plate mounted on said forward end of said unitary housing, said carburetor mounting plate having at least three openings for bolt insertion for mounting said intake manifold to a fuel carburetor, said carburetor mounting plate having a through opening the same size as said main intake manifold runner, and in alignment therewith; said unitary housing having at least two through openings for bolt insertion for mounting said intake manifold to an engine block.

* * * * *